US010383436B1

(12) United States Patent
Wakefield

(10) Patent No.: US 10,383,436 B1
(45) Date of Patent: Aug. 20, 2019

(54) BAR TABLE WITH A VISUAL IMAGE DISPLAY APPARATUS

(71) Applicant: Cornelius Wakefield, Douglasville, GA (US)

(72) Inventor: Cornelius Wakefield, Douglasville, GA (US)

( * ) Notice: Subject to any disclaimer, the term of this patent is extended or adjusted under 35 U.S.C. 154(b) by 0 days.

(21) Appl. No.: 15/291,844

(22) Filed: Oct. 12, 2016

(51) Int. Cl.
*A47B 37/02* (2006.01)
*A47F 9/00* (2006.01)
*H04R 1/02* (2006.01)

(52) U.S. Cl.
CPC ..... *A47B 37/02* (2013.01); *A47F 9/00* (2013.01); *H04R 1/028* (2013.01); *A47B 2220/0091* (2013.01); *H04R 2420/07* (2013.01); *H04R 2499/15* (2013.01)

(58) Field of Classification Search
CPC .... H04R 2420/07; H04R 1/1041; H04R 9/06; H04R 2499/15; H04R 2220/0091; G06F 1/1605; H04N 5/642; A47B 37/02; A47F 9/00; G03H 2001/0055; G03H 2001/2215; G03H 1/0005; G03H 1/2205
USPC ..... 359/32, 35, 15; 463/46; 312/223.1
See application file for complete search history.

(56) References Cited

U.S. PATENT DOCUMENTS

| | | | | |
|---|---|---|---|---|
| 4,475,126 | A | 10/1984 | Akins | |
| 6,621,530 | B1 | 9/2003 | Hall, Jr. et al. | |
| 7,470,030 | B2 | 12/2008 | Devos et al. | |
| 8,248,542 | B2 * | 8/2012 | Choi | G03B 21/006 348/744 |
| 2004/0080720 | A1 * | 4/2004 | Saito | A47B 37/02 353/79 |
| 2008/0239172 | A1 * | 10/2008 | Choi | G09G 3/002 348/836 |
| 2009/0197673 | A1 * | 8/2009 | Bone | G07F 17/32 463/25 |

* cited by examiner

*Primary Examiner* — Jade R Chwasz

(57) ABSTRACT

A bar table with a visual image display apparatus including a table and a pair of side countertop extensions. A door is hingedly disposed within a rear side of the table. A transparent projection screen is diagonally disposed within a front side of the table. An activation control is disposed on the front side of the table, a speaker having wireless capabilities is disposed on a bottom side of the table, a plurality of light emitting diodes is disposed on an underside of the speaker, and a projector is disposed within the table. The activation control is configured to activate the projector to project one of a plurality of holograms off the transparent projection screen so that a user can view one of the plurality of holograms when facing the front side of the table.

4 Claims, 5 Drawing Sheets

BAR TABLE WITH A VISUAL IMAGE DISPLAY APPARATUS

BACKGROUND OF THE INVENTION

Various types of bar tables are known in the prior art. However, what has been needed is a bar table with a visual image display apparatus including a table and a pair of side countertop extensions. What has been further needed is a door hingedly disposed within a rear side of the table, a transparent projection screen diagonally disposed within a front side of the table, an activation control disposed on the front side of the table, a speaker having wireless capabilities disposed on a bottom side of the table, a plurality of light emitting diodes disposed on an underside of the speaker, and a projector disposed within the table. Lastly, what has been needed is for the activation control to be configured to activate the projector to project one of a plurality of holograms off the transparent projection screen so that a user can view one of the plurality of holograms when facing the front side of the table. The bar table with a visual image display apparatus thus provides a uniquely structured bar table that not only has an integrated speaker and a plurality of light emitting diodes, but a projector configured to project a hologram onto a transparent projection screen for added ambiance and entertainment.

FIELD OF THE INVENTION

The present invention relates to bar tables, and more particularly, to a bar table with a visual image display apparatus.

SUMMARY OF THE INVENTION

The general purpose of the present bar table with a visual image display apparatus, described subsequently in greater detail, is to provide a bar table with a visual image display apparatus which has many novel features that result in a bar table with a visual image display apparatus which is not anticipated, rendered obvious, suggested, or even implied by prior art, either alone or in combination thereof.

To accomplish this, the present bar table with a visual image display apparatus includes a table having a front side, a rear side, a right side, a left side, a countertop surface, a bottom side, and at least two leg support members extended from each of the right side and the left side to a ground surface. The countertop surface is optionally rectangular, and each of the right side and the left side of the table is optionally tapered inward from the countertop surface to the bottom side. Each of a right countertop extension and a left countertop extension of a pair of side countertop extensions has a linear inner side attached to each of the right side and the left side, respectively, of the table proximal the countertop surface. Each of the right countertop extension and the left countertop extension is optionally semicircular. A door is hingedly disposed within the rear side of the table. A transparent projection screen is diagonally disposed within the front side of the table. A recess, optionally rectangular, is disposed within the countertop surface of the table from the rear side to approximately one-quarter of a length from the rear side to the front side. The recess has a front wall, a pair of side walls, and a rear countertop surface. Each of the countertop surface of the table and the rear countertop surface of the recess provides a bar top surface for drinks and beverages.

The bar table with a visual image display apparatus further includes an activation control disposed on the front side of the table. A speaker having wireless capabilities is disposed on the bottom side of the table proximal to the front side. The speaker is configured to wirelessly connect to a remotely disposed personal electronic device in order to play music from the personal electronic device through the speaker. A personal electronic device can include, but not be limited to, a cellular phone and a computer. A plurality of forward facing light emitting diodes is disposed on an underside of the speaker, and a projector is disposed within the table. The activation control is configured to activate the projector to project one of a plurality of holograms off the transparent projection screen so that a user can view one of the plurality of holograms when facing the front side of the table.

Lastly, the bar table with a visual image display apparatus further includes a power cord having a proximal end and a distal end. The proximal end is in operational communication with each of the projector, the speaker, and the plurality of forward facing light emitting diodes, and the distal end is extended outward from the rear side of the table and removably engageable with a power source.

Thus has been broadly outlined the more important features of the present bar table with a visual image display apparatus so that the detailed description thereof that follows may be better understood and in order that the present contribution to the art may be better appreciated.

BRIEF DESCRIPTION OF THE DRAWINGS

FIGURES

Figure 1:
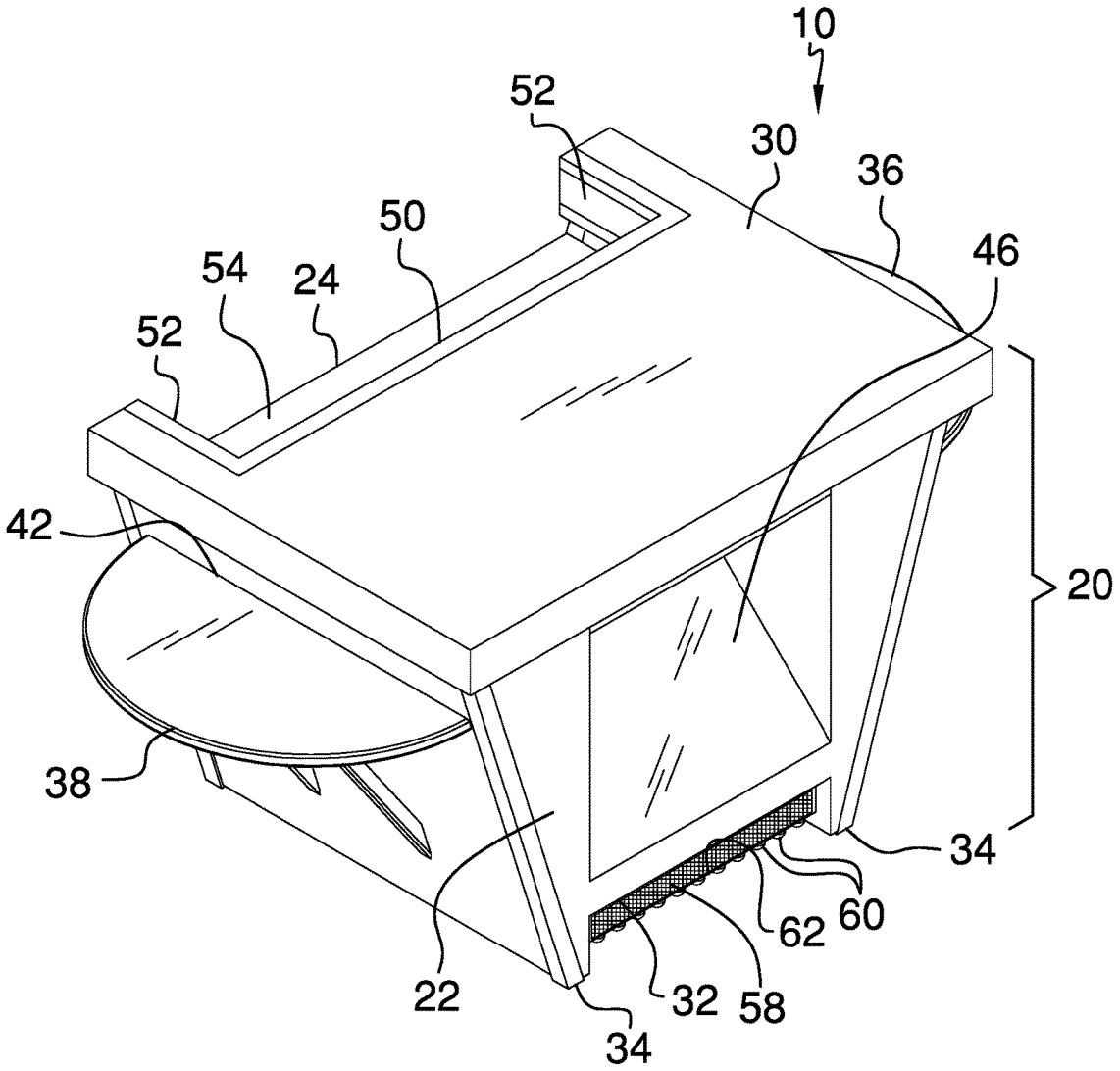

FIG. 1 is a front isometric view.

Figure 2:
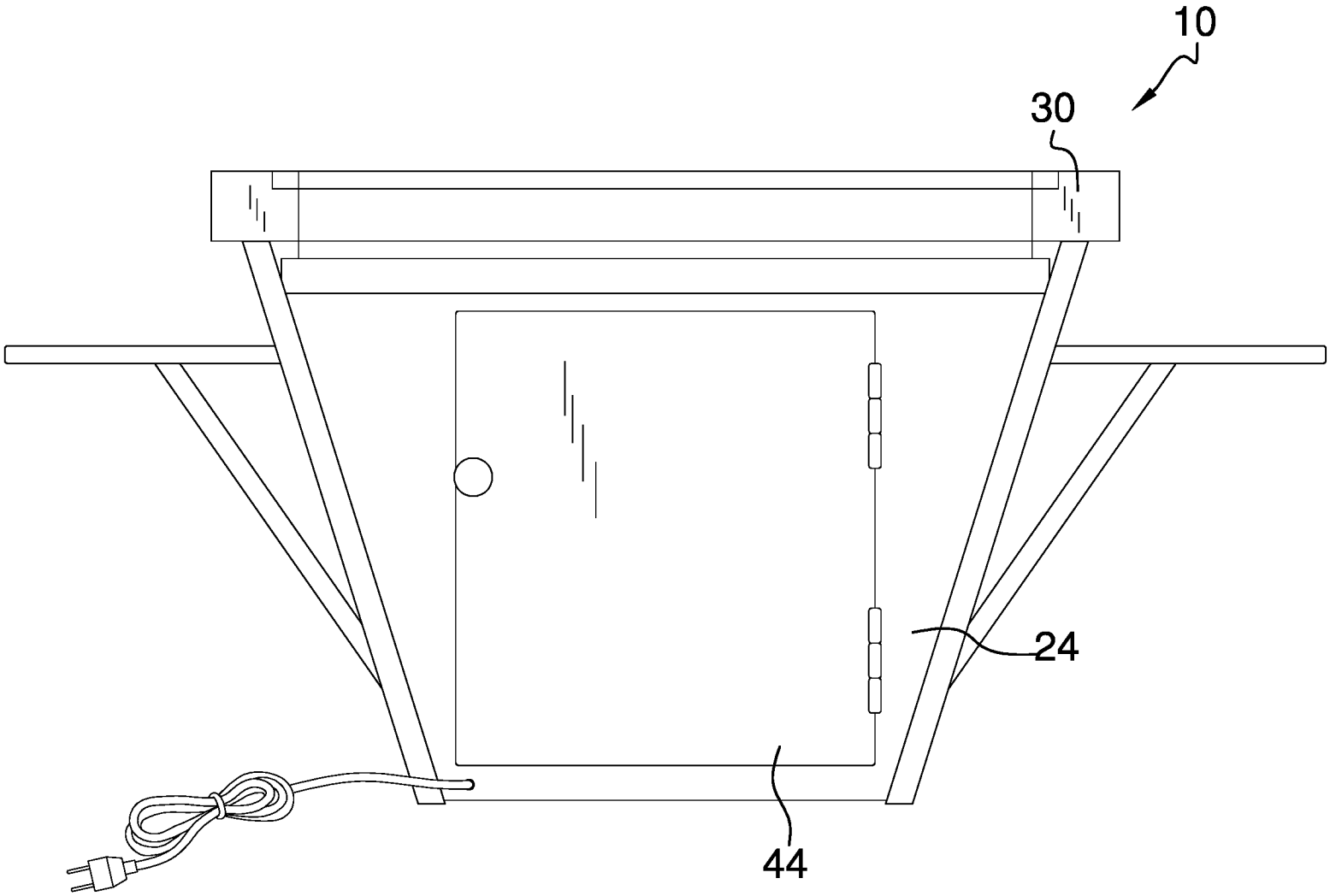

FIG. 2 is a rear elevation view.

Figure 3:
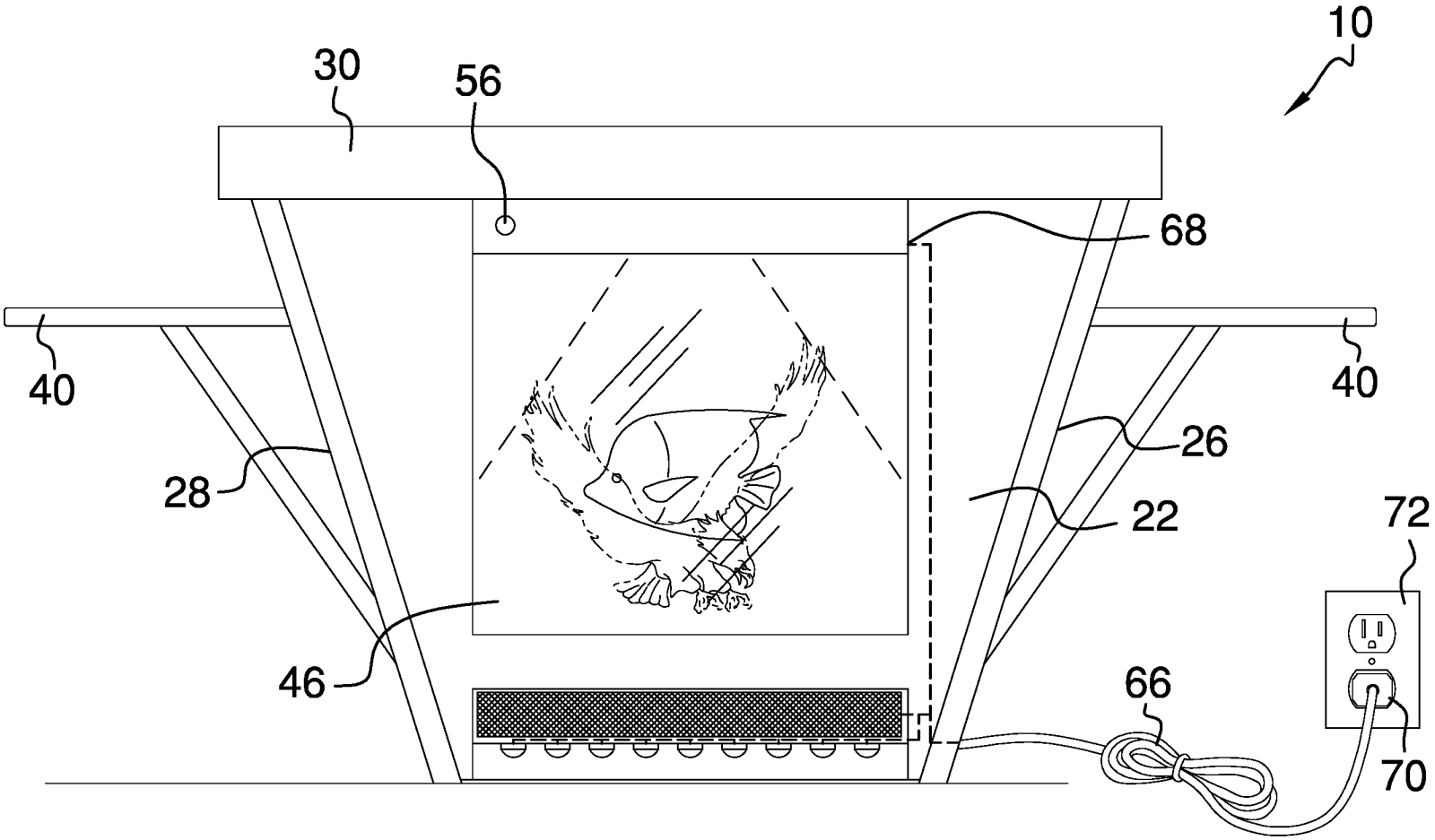

FIG. 3 is a front elevation view.

Figure 4:
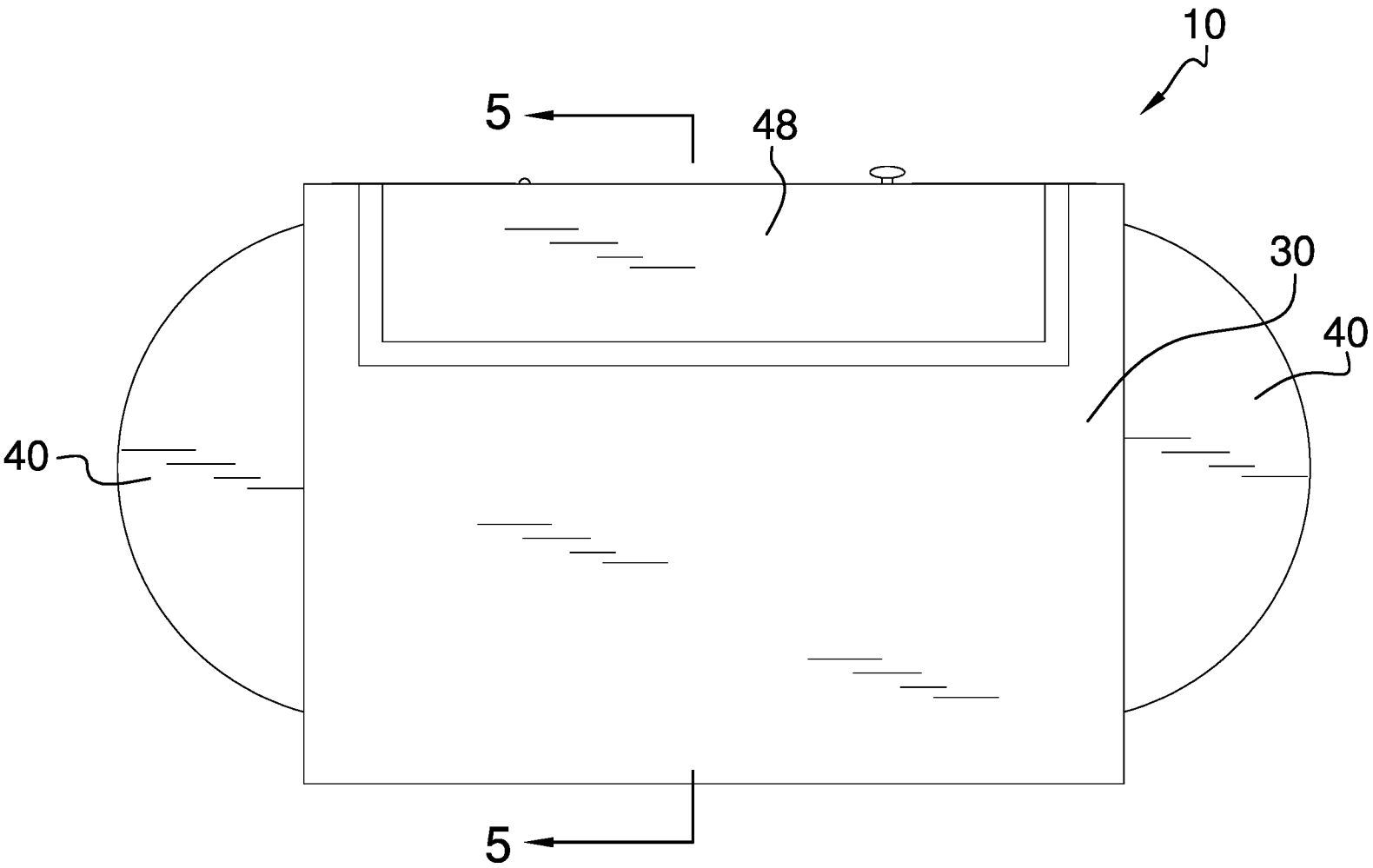

FIG. 4 is a top plan view.

Figure 5:
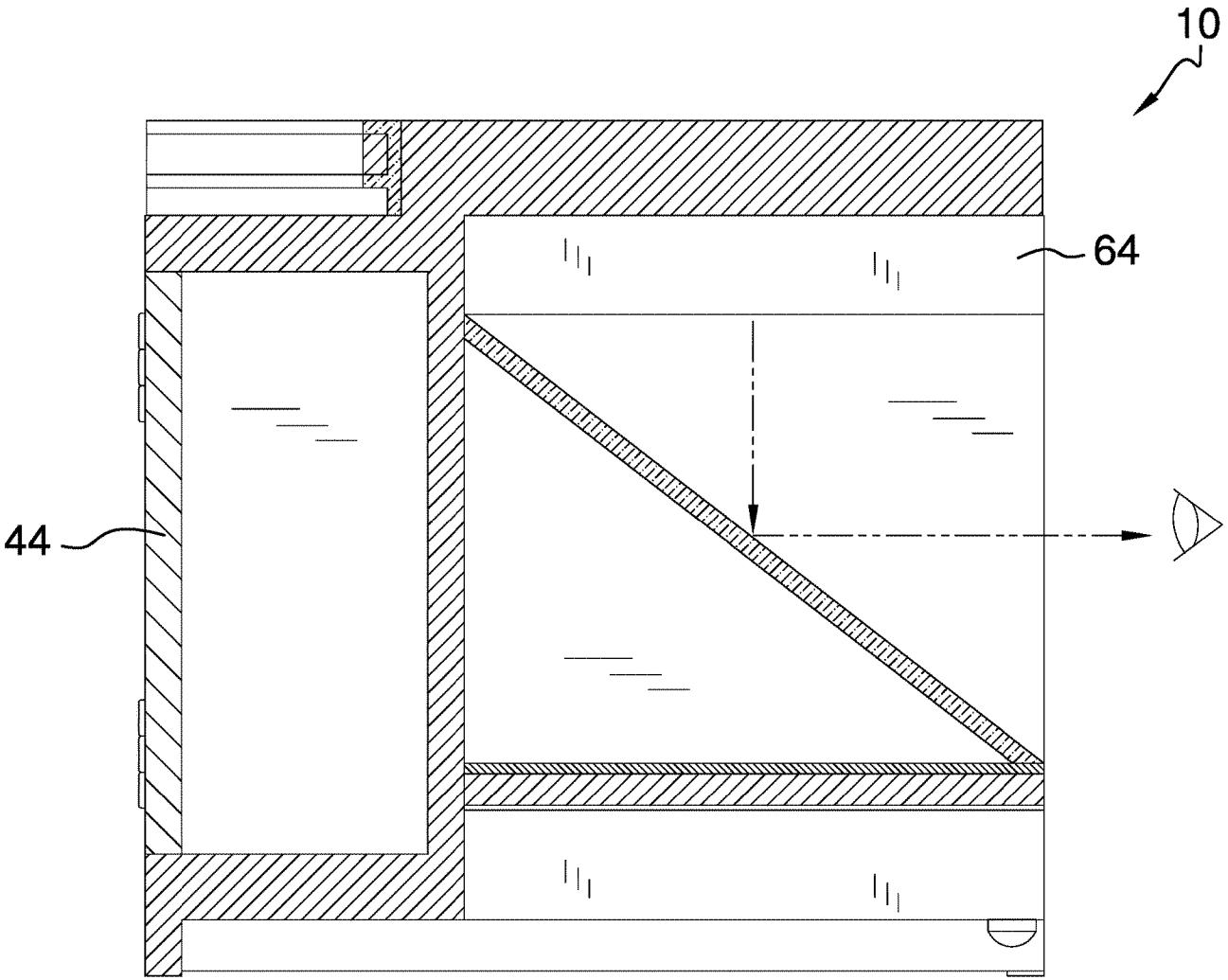

FIG. 5 is a cross-sectional view taken along line 5-5 of FIG. 4.

DETAILED DESCRIPTION OF THE DRAWINGS

With reference now to the drawings, and in particular FIGS. 1 through 5 thereof, an example of the instant bar table with a visual image display apparatus employing the principles and concepts of the present bar table with a visual image display apparatus and generally designated by the reference number 10 will be described.

Referring to FIGS. 1 through 5 the present bar table with a visual image display apparatus 10 is illustrated. The bar table with a visual image display apparatus 10 includes a table 20 having a front side 22, a rear side 24, a right side 26, a left side 28, a countertop surface 30, a bottom side 32, and at least two leg support members 34 extended from each of the right side 26 and the left side 28 to a ground surface. The countertop surface 30 is optionally rectangular, and each of the right side 26 and the left side 28 of the table 20 is optionally tapered inward from the countertop surface 30 to the bottom side 32. Each of a right countertop extension 36 and a left countertop extension 38 of a pair of side countertop extensions 40 has a linear inner side 42 attached to each of the right side 26 and the left side 28, respectively, of the table 20 proximal the countertop surface 30. Each of the right countertop extension 36 and the left countertop extension 38 is optionally semicircular. A door 44 is hingedly disposed within the rear side 24 of the table 20. A transparent projection screen 46 is diagonally disposed within the front side 22 of the table 20. A recess 48, optionally rectangular, is disposed within the countertop surface 30 of the table 20 from the rear side 24 to approximately one-quarter of a length from the rear side 24 to the front side 22. The recess 48 has a front wall 50, a pair of side walls 52, and a rear countertop surface 54.

The bar table with a visual image display apparatus 10 further includes an activation control 56 disposed on the front side 22 of the table 20. A speaker 58 having wireless capabilities is disposed on the bottom side 32 of the table 20 proximal to the front side 22. A plurality of forward facing light emitting diodes 60 is disposed on an underside 62 of the speaker 58, and a projector 64 is disposed within the table 20.

Lastly, the bar table with a visual image display apparatus 10 further includes a power cord 66 having a proximal end 68 and a distal end 70. The proximal end 68 is in operational communication with each of the projector 64, the speaker 58, and the plurality of forward facing light emitting diodes 60, and the distal end 70 is extended outward from the rear side 24 of the table 20 and removably engageable with a power source 72.

What is claimed is:

1. A bar table with a visual image display apparatus comprising:

a table having a front side, a rear side, a right side, a left side, a countertop surface, a bottom side, and at least two leg support members extended from each of the right side and the left side to a ground surface;

a pair of side countertop extensions comprising a right countertop extension and a left countertop extension, each of the right countertop extension and the left countertop extension having a linear inner side attached to each of the right side and the left side, respectively, of the table proximal the countertop surface;

a transparent projection screen diagonally disposed within the front side of the table;

a recess disposed within the countertop surface of the table from the rear side to approximately one-quarter of a length from the rear side to the front side, the recess having a front wall, a pair of side walls, and a rear countertop surface;

an activation control disposed on the front side of the table;

a door hingedly disposed within the rear side of the table;

a speaker disposed on the bottom side of the table proximal to the front side;

wherein the speaker is configured to wirelessly connect to a remotely disposed personal electronic device in order to play music from the personal electronic device through the speaker;

a plurality of forward facing light emitting diodes disposed on an underside of the speaker;

a projector disposed within the table;

wherein the activation control is configured to activate the projector to project one of a plurality of images off the transparent projection screen so that a user can view one of the one of the plurality of images when facing the front side of the table; and a power cord having a proximal end and a distal end, wherein the proximal end is in operational communication with each of the projector, the speaker, and the plurality of forward facing light emitting diodes, and the distal end is extended outward from the rear side of the table and removably engageable with a power source.

2. The bar table with a visual image display apparatus of claim 1 wherein each of the right side and the left side of the table is tapered inward from the countertop surface to the bottom side.

3. The bar table with a visual image display apparatus of claim 2 wherein each of the pair of side countertop extensions is semicircular.

4. The bar table with a visual image display apparatus of claim 3 wherein each of the countertop surface of the table and the recess is rectangular.

* * * * *